US010770836B2

(12) United States Patent
Henry et al.

(10) Patent No.: US 10,770,836 B2
(45) Date of Patent: Sep. 8, 2020

(54) PLUG CONNECTOR INCLUDING A PROFILED LATCH

(71) Applicant: TE CONNECTIVITY CORPORATION, Berwyn, PA (US)

(72) Inventors: Randall Robert Henry, Lebanon, PA (US); James Charles Shiffler, Hershey, PA (US); Michael John Phillips, Camp Hill, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/221,703

(22) Filed: Dec. 17, 2018

(65) Prior Publication Data

US 2020/0194932 A1 Jun. 18, 2020

(51) Int. Cl.

| | |
|---|---|
| ***H01R 13/627*** | (2006.01) |
| ***H01R 12/71*** | (2011.01) |
| ***H01R 13/516*** | (2006.01) |
| ***H01R 13/629*** | (2006.01) |

(52) U.S. Cl.

CPC ..... *H01R 13/6275* (2013.01); *H01R 12/716* (2013.01); *H01R 13/516* (2013.01); *H01R 13/629* (2013.01)

(58) Field of Classification Search

CPC ..... H01R 13/6275; H01R 12/716; H01R 13/516; H01R 13/629

USPC ..... 439/352, 345, 353, 354, 358

See application file for complete search history.

(56) References Cited

U.S. PATENT DOCUMENTS

| | | | | |
|---|---|---|---|---|
| 2,647,245 | A * | 7/1953 | Gilbert | H01R 4/2404 439/417 |
| 4,664,460 | A * | 5/1987 | Vandame | H01R 13/4223 439/595 |
| 5,711,687 | A * | 1/1998 | Kuiper-Moore | H01R 13/434 439/745 |
| 6,234,828 | B1 * | 5/2001 | Kuo | H01R 13/6275 439/358 |
| 6,890,189 | B1 * | 5/2005 | Wu | H01R 13/6581 439/76.1 |
| 7,591,664 | B2 * | 9/2009 | Nomiyama | H01R 13/6275 439/352 |
| 9,379,484 | B2 | 6/2016 | Phillips et al. | |
| 9,728,871 | B1 | 8/2017 | Gutgold et al. | |
| 10,263,349 | B2 | 4/2019 | Phillips et al. | |
| 2015/0288104 | A1 * | 10/2015 | Regnier | H01R 24/62 439/676 |
| 2016/0315418 | A1 * | 10/2016 | Sutter | H01R 13/6471 |

OTHER PUBLICATIONS

U.S. Appl. No. 16/049,163, filed Jul. 30, 2018 (57 pages).

* cited by examiner

*Primary Examiner* — Travis S Chambers

(57) ABSTRACT

A plug connector includes a housing having a front and a rear, a first end and a second end opposite the first end, and a first side and a second side opposite the first side. The housing has a mating end at the front for mating with a mating connector. The housing has a latch pocket at the first end. The plug connector includes plug contacts held by the housing provided proximate to the mating end for mating with the mating connector. The plug connector includes a latch received in the latch pocket having a main body and a latch beam extending from the main body. The latch beam includes a dual tip latch including a first tip latch and a second tip latch both configured to be received in a same latch opening of the mating connector.

20 Claims, 3 Drawing Sheets

PLUG CONNECTOR INCLUDING A PROFILED LATCH

BACKGROUND OF THE INVENTION

The subject matter herein relates generally to latches for plug connectors.

Connector systems including mating connectors configured to be separably mated for data and/or power transmission through the connector system. For example, the connector systems typically include complementary plug connectors and receptacle connectors configured to be mated to and unmated from each other. The connectors typically include latching features to secure mating of the plug connector with the receptacle connector. For example, the plug connector may include a deflectable latch configured to be received in a latch opening of the receptacle connector. Some latches are manufactured from plastic, which are subject to failure or breaking due to excessive force applied to the latch. Other latches are manufactured from metal, such as being stamped and formed to include a latching tip. However, the latching tips are thin and may form a knife-like edge that may shear or cut into the structure defining the latch opening, leading to damage to the receptacle connector or the plug connector.

A need remains for a cost effective and reliable latching system for a plug connector.

BRIEF DESCRIPTION OF THE INVENTION

In one embodiment, a plug connector is provided including a housing having a front and a rear, a first end and a second end opposite the first end, and a first side and a second side opposite the first side. The housing has a mating end at the front for mating with a mating connector. The housing has a latch pocket at the first end. The plug connector includes plug contacts held by the housing provided proximate to the mating end for mating with the mating connector. The plug connector includes a latch received in the latch pocket having a main body and a latch beam extending from the main body. The latch beam includes a dual tip latch including a first tip latch and a second tip latch both configured to be received in a same latch opening of the mating connector.

In another embodiment, a plug connector is provided including a housing having a front and a rear, a first end and a second end opposite the first end, and a first side and a second side opposite the first side. The housing has a mating end at the front for mating with a mating connector. The housing has a latch pocket at the first end. The plug connector includes plug contacts held by the housing provided proximate to the mating end for mating with the mating connector. The plug connector includes a latch received in the latch pocket having a main body and a latch beam extending from the main body. The latch beam includes a dual tip latch. The latch beam includes a base at a bottom of the latch beam. The latch beam includes a first side wall extending from a first side of the base and a second side wall extending from a second side of the base. The second side wall is spaced apart from the first side wall by a gap. The latch beam includes a first tip latch extending from a top of the first side wall and a second tip latch extending from a top of the second side wall. The first and second tip latches are both configured to be received in a same latch opening of the mating connector.

In a further embodiment, a plug connector is provided including a housing having a front and a rear, a first end and a second end opposite the first end, and a first side and a second side opposite the first side. The housing has a mating end at the front for mating with a mating connector. The housing has a latch pocket at the first end. The plug connector includes plug contacts held by the housing provided proximate to the mating end for mating with the mating connector. The plug connector includes a latch received in the latch pocket having a main body extending between a first side and a second side. The latch has a first latch beam extending from the main body proximate to the first side and a second latch beam extending from the mating body proximate to the second side. The first latch beam includes a dual tip latch including a first tip latch and a second tip latch both configured to be received in a first latch opening of the mating connector. The second latch beam includes a dual tip latch including a third tip latch and a fourth tip latch both configured to be received in a second latch opening of the mating connector.

DETAILED DESCRIPTION OF THE INVENTION

Figure 1:
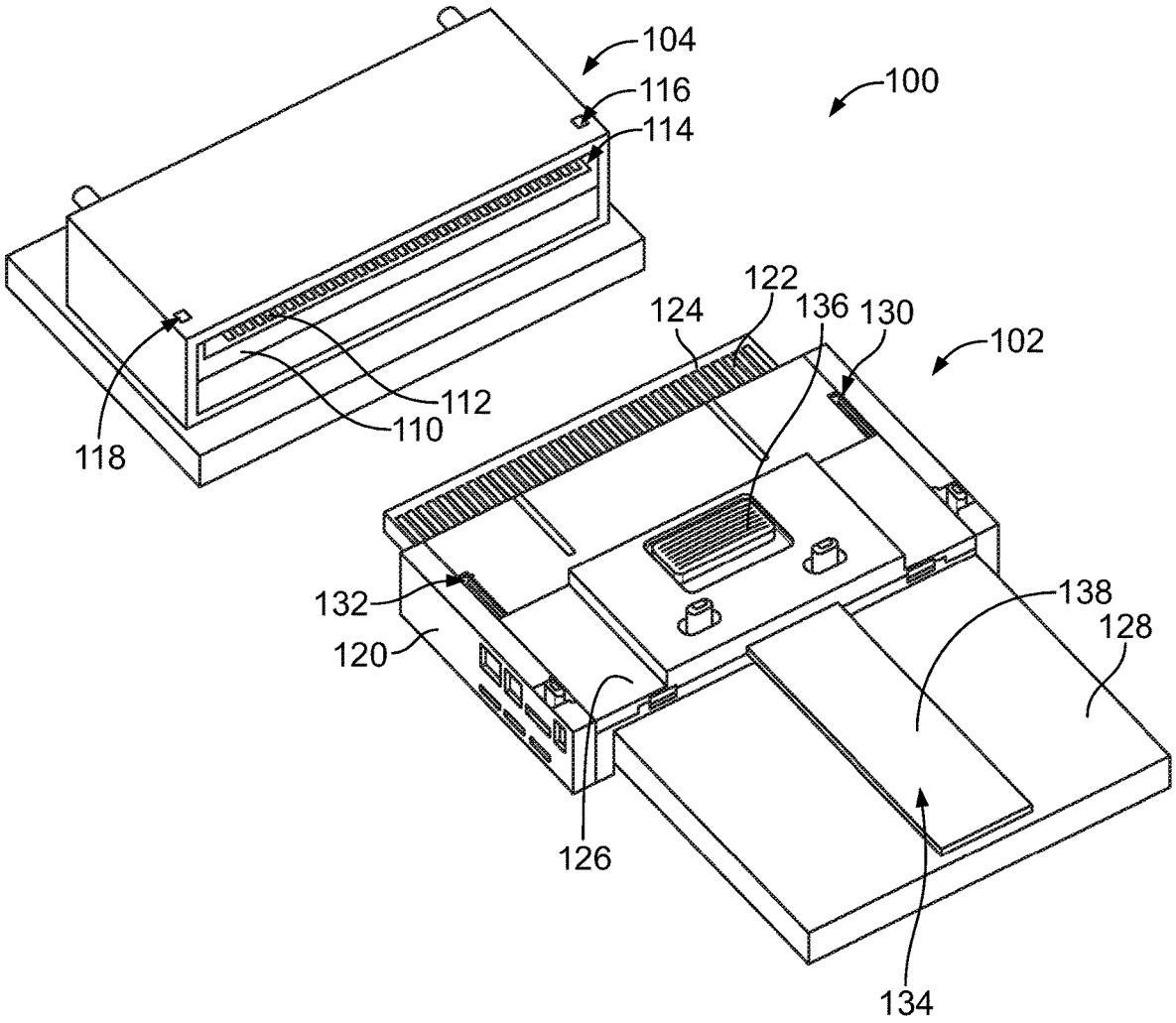
FIG. 1 illustrates a connector system formed in accordance with an exemplary embodiment.

FIG. 1 illustrates a connector system 100 formed in accordance with an exemplary embodiment. The connector system 100 includes a plug connector 102 and a receptacle connector 104. The plug connector 102 is configured to be mated with the receptacle connector 104 at a separable mating interface. The receptacle connector 104 defines a mating connector for the plug connector 102.

The receptacle connector 104 includes a housing 110 holding receptacle contacts 112 configured to be mated with the plug connector 102. In the illustrated embodiment, the receptacle connector 104 includes a cavity 114 that receives a portion of the plug connector 102. For example, the receptacle connector 104 includes a card slot configured to receive a circuit card of the plug connector 102. The receptacle contacts 112 are spring beam contacts configured to be mated with the circuit card. However, the receptacle contacts 112 may be other types of contacts in alternative embodiments, such as contact pads. In other various embodiments, the housing 110 of the receptacle connector 104 may hold a circuit card configured to be mated with the plug connector 102. For example, the receptacle contacts 112 may be contact pads on the circuit card.

The receptacle connector 104 includes latching features 116 for latchably securing the plug connector 102 to the receptacle connector 104. In the illustrated embodiment, the latching features 116 include latch openings 118 in the housing 110 configured to receive complementary latching features of the plug connector 102.

The plug connector 102 includes a housing 120 holding plug contacts 122 configured to be mated with corresponding receptacle contacts 112 of the receptacle connector 104.

In the illustrated embodiment, the receptacle connector 104 includes a circuit card 124 configured to be plugged into the card slot or cavity 114 of the receptacle connector 104. The plug contacts 122 are contact pads at a card edge of the circuit card 124. However, the plug contacts 122 may be other types of contacts in alternative embodiments, such as spring beams. In other various embodiments, the housing 120 of the plug connector 102 may include a card slot configured to receive a circuit card of the receptacle connector 104 and the housing 120 may hold discrete plug contacts 122, such as spring beam contacts, for mating to the circuit card or other types of mating contacts.

The plug connector 102 includes a cover 126 coupled to the housing 120. The cover 126 closes the housing 120, such as at the top of the housing 120. The cover 126 may be used to secure the circuit card 124 in the housing 120.

In an exemplary embodiment, the plug connector 102 includes cables 128 extending from the rear of the housing 120. The cables 128 are electrically connected to corresponding plug contacts 122. For example, the cables 128 may be terminated to the circuit card 124, such as by soldering.

The plug connector 102 includes a latch 130 for latchably securing the plug connector 102 to the receptacle connector 104. The latch 130 is coupled to the housing 120. The latch 130 may be secured in the housing 120 using the cover 126. For example, the cover 126 may cover a portion of the latch 130. In the illustrated embodiment, the latch 130 includes latch beams 132 configured to be received in the latch openings 118 of the receptacle connector 104.

The plug connector 102 includes an actuator 134 operably coupled to the latch 130 for actuating the latch 130 to move the latch beams 132 between latched positions and unlatched positions, such as to release the plug connector 102 from the receptacle connector 104. The actuator 134 may be coupled to the housing 120 and/or the cover 126. In the illustrated embodiment, the actuator 134 includes a push button 136 for actuating the latch 130 and a pull tab 138 for actuating the latch 130. However, in other various embodiments, the actuator 134 may be provided without the push button 136 and/or without the pull tab 138 and may include other types of actuating features. The push button 136 causes actuation of the latch 130 by pushing the latch 130 inward or downward to cause the latch beams 132 to move to unlatched positions. For example, an inner surface of the actuator 134 engages the latch 130 to push the latch 130 inward. The latch beams 132 are moved inward or downward when the push button 136 is pushed inward. The latch 130 may be pivoted or rotated to move the latch beams 132. The pull tab 138 causes actuation of the latch 130 by pushing the latch 130 inward or downward to cause the latch beams 132 to move to unlatched positions. For example, an inner surface of the actuator 134 may be ramped and pulled rearward with the pull tab to engage the latch 130 to push the latch 130 inward. The latch beams 132 are moved inward or downward when the pull tab 138 is pulled rearward.

Figure 2:
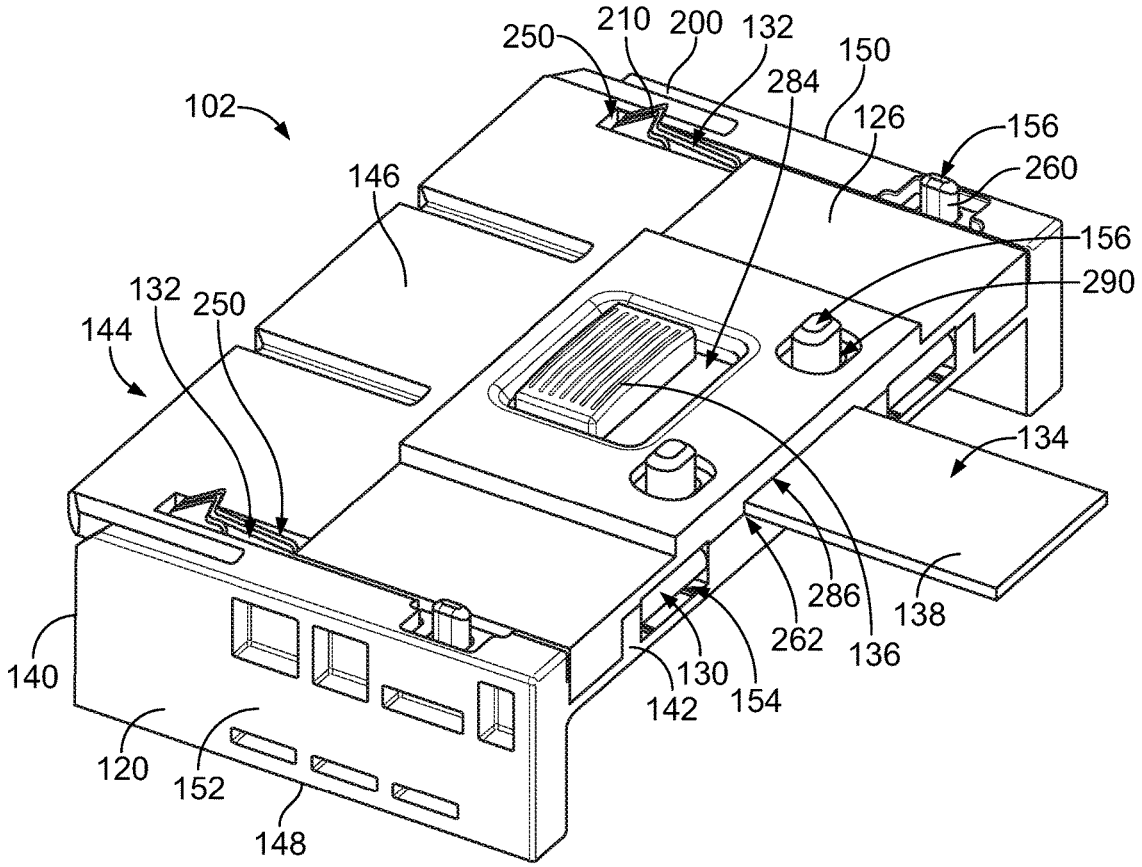
FIG. 2 is a rear perspective view of a plug connector of the connector system in accordance with an exemplary embodiment.

FIG. 2 is a rear perspective view of the plug connector 102 in accordance with an exemplary embodiment. The housing 120 of the plug connector 102 includes a front 140 and a rear 142. The plug contacts 122 (shown in FIG. 1) may be located proximate to the front 140 for mating with the receptacle connector 104 (shown in FIG. 1). In an exemplary embodiment, the housing 120 has a mating end 144 at the front 140 for mating with the mating connector defined by the receptacle connector 104.

The housing 120 includes a first end 146 and a second end 148 opposite the first end 146. The first and second ends 146, 148 extend between the front 140 and the rear 142. In various orientations, the first end 146 may be a top end and the second end 148 may be a bottom end; however, other orientations are possible in alternative embodiments. The latch 130 may be provided at the first end 146. The cover 126 is coupled to the housing 120 at the first end 146.

The housing 120 includes a first side 150 and a second side 152 opposite the first side 150. The first and second sides 150, 152 extend between the front 140 and the rear 142. The first and second sides 150, 152 extend between the first end 146 and the second end 148. In various embodiments, the housing 120 may be generally rectangular shaped; however, other shapes are possible in alternative embodiments.

In an exemplary embodiment, the housing 120 has a latch pocket 154 at the first end 146. The latch pocket 154 may be located proximate to the rear 142. The latch 130 is received in the latch pocket 154. Optionally, at least a portion of the cover 126 is received in the latch pocket 154. The cover 126 is coupled to the housing 120 to secure the latch 130 in the latch pocket 154. In an exemplary embodiment, the housing 120 includes securing features 156 for securing the cover 126 to the housing 120. For example, the securing features 156 may be heat stakes, interference posts, crush ribs, fasteners, and the like. Optionally, at least a portion of the actuator 134 is received in the latch pocket 154. For example, the push button 136 may extend into the latch pocket 154 to interface with the latch 130 and/or a portion of the pull tab 138 may extend into the latch pocket 154 to interface with the latch 130. In the illustrated embodiment, the push button 136 extends from the top and the pull tab 138 extends from the rear 142.

Figure 3:
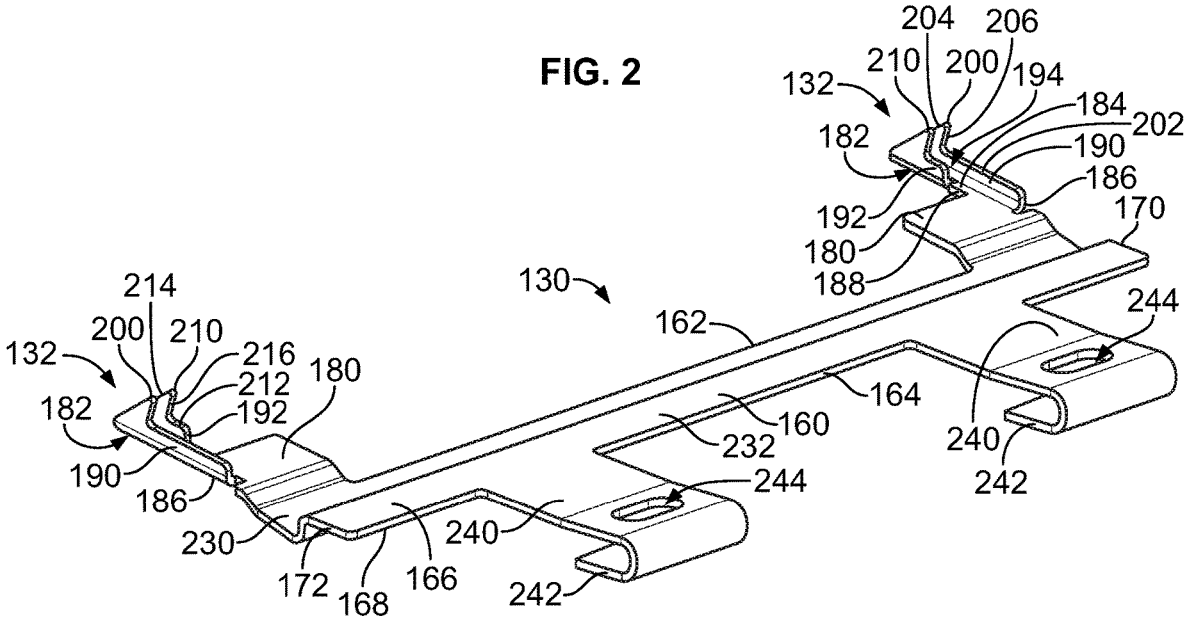
FIG. 3 is a rear perspective view of a latch of the plug connector in accordance with an exemplary embodiment.

FIG. 3 is a rear perspective view of the latch 130 in accordance with an exemplary embodiment. The latch 130 includes a main body 160 extending between a front 162 and a rear 164. The main body 160 includes a first end 166 and a second end 168 opposite the first end 166. The first and second ends 166, 168 extend between the front 162 and the rear 164. In various orientations, the first end 166 may be a top end and the second end 168 may be a bottom end; however, other orientations are possible in alternative embodiments. The main body 160 includes a first side 170 and a second side 172 opposite the first side 170. The first and second sides 170, 172 extend between the front 162 and the rear 164.

The latch beams 132 extend from the main body 160, such as from the front 162. In the illustrated embodiment, two latch beams 132 are provided; however, greater or fewer latch beams 132 may be provided in alternative embodiments. In the illustrated embodiment, the latch beams 132 are provided proximate to the first side 170 and the second side 172. Other locations are possible in alternative embodiments. The latch beams 132 have dual tip latches providing dual latching surfaces for each latch beam 132. The dual tip latches provide greater surface area for latching engagement with the receptacle connector 104. The dual tip latches spread the latching forces, such as to reduce rotation or angular displacement when mated and during unmating.

In an exemplary embodiment, each latch beam 132 includes a support arm 180 extending forward from the main body 160 and a latching arm 182 extending from the support arm 180. In the illustrated embodiment, the latching arm 182 extends forward of the support arm 180 and upward from the support arm 180. The support arm 180 may be located at the corresponding first or second side 170, 172.

The latching arm 182 of the latch beam 132 includes a base 184 at a bottom of the latch beam 132. The base 184 extends between a first side 186 and a second side 188. The first side 186 may be an outer side and the second side 188 may be an inner side. The latch beam 132 includes a first side wall 190 extending from the first side 186 of the base 184. The first side wall 190 extends upward. The first side wall 190 may be formed by being bent at the corner between the first side wall 190 and the base 184. The latch beam 132 includes a second side wall 192 extending from the second side 188 of the base 184. The second side wall 192 extends upward. The second side wall 192 may be formed by being bent at the corner between the second side wall 192 and the base 184. Optionally, the first side wall 190 is longer than the second side wall 192. For example, the first side wall 190 may extend along the support arm 180.

The first and second side walls 190, 192 are upstanding to increase stiffness of the latch beam 132. For example, the latch beam 132 is U-shaped defined by the base 184 and the first and second side walls 190, 192 at opposite sides of the base 184. The first and second side walls 190, 192 reduce bending or failing of the base 184 by strengthening the base 184 at both sides 186, 188 of the base 184. The second side wall 192 is spaced apart from the first side wall 190 by a gap 194. The gap 194 is the width of the base 184 between the sides 186, 188. The gap 194 spreads the latching surfaces of the dual tip latch apart from each other to spread latching forces apart and provide a wide latching area for the latch beam 132.

The latch beam 132 includes a first tip latch 200 extending from a top 202 of the first side wall 190. The first tip latch 200 includes a ramp 204 at a front of the first tip latch 200 and a latching surface 206 at a rear of the first tip latch 200. The ramp 204 is forward and upward facing. The latching surface 206 is rearward facing. Optionally, the latching surface 206 may be vertical. The latching surface 206 may be perpendicular to the top 202. In various embodiments, the first tip latch 200 is provided at a distal end or forward end of the latch beam 132.

The latch beam 132 includes a second tip latch 210 extending from a top 212 of the second side wall 192. The second tip latch 210 includes a ramp 214 at a front of the second tip latch 210 and a latching surface 216 at a rear of the second tip latch 210. In various embodiments, the second tip latch 210 is provided at a distal end or forward end of the latch beam 132. The ramp 214 is forward and upward facing. The latching surface 216 is rearward facing. Optionally, the latching surface 216 may be vertical. The latching surface 216 may be perpendicular to the top 212. In an exemplary embodiment, the latching surface 216 is parallel to and aligned with the latching surface 206 across the gap 194.

In an exemplary embodiment, the main body 160 of the latch 130 includes a deflecting tab 230 at the front 162 and a base 232 at the rear 164. The deflecting tab 230 is deflectable relative to the base 232. The deflecting tab 230 is configured to be engaged by the actuator 134 (shown in FIG. 2) to move the deflecting tab 230 between an undeflected position and a deflected position. The deflecting tab 230 may be moved downward to the deflected position in various embodiments. Optionally, the deflecting tab 230 may be rotated or pivoted relative to the base 232 between the undeflected position and the deflected position. The deflecting tab 230 may have a curved transition at the base 232. The deflecting tab 230 may be rotated at the curved transition. The support arms 180 extend forward from the deflecting tab 230, such as at the first and second sides 170, 172.

In an exemplary embodiment, the latch 130 includes mounting tabs 240 extending rearward from the main body 160. The mounting tabs 240 are used to mount the latch 130 and the housing 110. In the illustrated embodiment, a pair of mounting tabs 240 are provided, however, greater or fewer mounting tabs 240 may be provided in alternative embodiments. Each mounting tab 240 includes a securing arm 242 for securing the mounting tab 240 to the housing 110. In the illustrated embodiment, the securing arm 242 is folded under the mounting tab 240. The securing arm 242 of the mounting tab 240 forms a clip for securing the latch 130 to the housing 110. In an exemplary embodiment, the mounting tab 240 includes an opening 244 extending therethrough. The opening 244 may be used for locating the latch 130 relative to the housing 110. Other types of securing features may be used in alternative embodiments.

Figure 4:
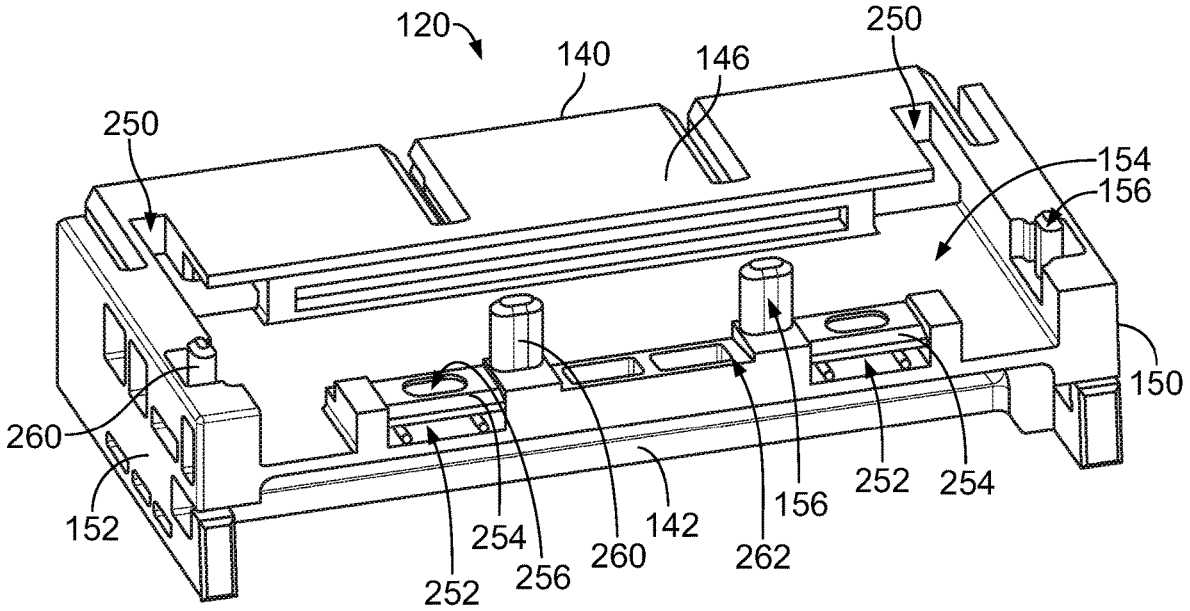
FIG. 4 is a rear perspective view of a housing of the plug connector in accordance with an exemplary embodiment.

FIG. 4 is a rear perspective view of the housing 120 of the plug connector 102 in accordance with an exemplary embodiment. FIG. 4 illustrates the latch pocket 154 that receives the latch 130 (shown in FIG. 3). In the illustrated embodiment, the latch pocket 154 is open at the first end 146 to receive the latch 130. The latch pocket 154 may be open at the rear 142 to receive the latch 130. The latch pocket 154 is a hollow space in the housing 120 configured to receive the main body 160 (shown in FIG. 3) of the latch 130 and allow the latch 130 to deflect within the housing 120.

In an exemplary embodiment, the housing 120 includes latch beam channels 250 configured to receive corresponding latch beams 132 of the latch 130. The latch beam channels 250 extend forward of the latch pocket 154. In the illustrated embodiment, the latch beam channels 250 are open at the first end 146 to allow the latch beams 132 to interface with the receptacle connector 104 during mating. In the illustrated embodiment, the latch beam channels 250 are provided proximate to the first and second sides 150, 152 of the housing 120. The latch beams 132 are deflectable within the latch beam channels 250 between latched positions and unlatched positions.

In an exemplary embodiment, the housing 120 includes mounting slots 252 at the rear 142 that receive corresponding mounting tabs 240 (shown in FIG. 3). For example, the mounting slots 252 receive the securing arms 242 of the mounting tabs 240. Optionally, the housing 120 may include crush ribs within the mounting slots 252 configured to interface with the securing arms 242 and hold the securing arms 242 and the mounting slots 252 by an interference fit. The housing 120 includes support bridges 254 extending along and defining the mounting slots 252. The support bridges 254 support the mounting tabs 240 while the securing arms 242 wrap around the support bridges 254 into the mounting slots 252. In an exemplary embodiment, the support bridges 254 include openings 256 the openings 256 are configured to be aligned with the openings 244 (shown in FIG. 3) of the mounting tabs 240. In an exemplary embodiment, the openings 256 are configured to receive the locating tabs of the cover 126 (shown in FIG. 5).

In an exemplary embodiment, the securing features 156 of the housing 120 include support posts 260 for supporting the cover 126 on the housing 120. The support posts 260 are accessible at the first end 146. For example, the support posts 260 may be upstanding posts configured to receive the cover 126 being coupled to the housing 120 in a downward mating direction. Optionally, the support posts 260 may be deformed, such as by heat staking, to lock the cover 126 to the housing 120. Other types of securing features may be provided to secure the cover 126 to the housing 120.

In an exemplary embodiment, the housing 120 includes an actuator slot 262 that receives the actuator 134 (shown in FIG. 2). The actuator slot 262 is located at the rear 142. The actuator slot 262 may be open at the first end 146 to receive the actuator 134 from above. Optionally, the actuator slot 262 may be centered between the first side 150 and the second side 152.

Figure 5:
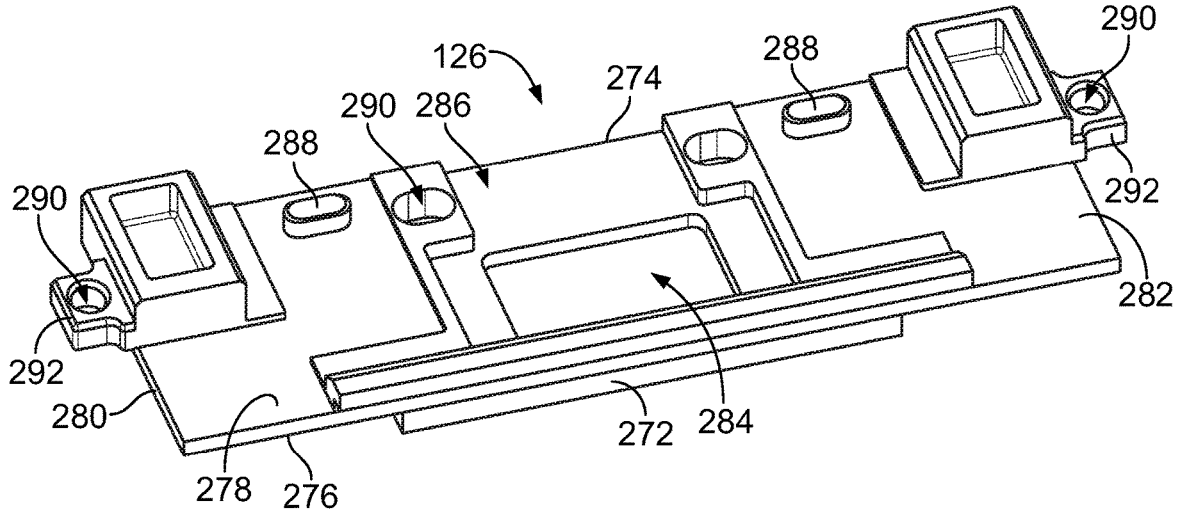
FIG. 5 is a bottom perspective view of a cover of the plug connector in accordance with an exemplary embodiment.

FIG. 5 is a bottom perspective view of the cover 126 in accordance with an exemplary embodiment. The cover 126 extends between a front 272 and a rear 274. The cover 126 has an outer end 276 and an inner end 278. The cover 126 extends between a first side 280 and a second side 282. The outer end 276 may define a top of the cover 126 and the inner end 278 may define a bottom of the cover 126. The inner end 278 is configured to face the first end 146 of the housing 120.

The cover 126 includes an actuator opening 284 that receives a portion of the actuator 134, such as the push button 136 (shown in FIG. 2). The actuator opening 284 is open between the outer end 276 and the inner end 278. The actuator opening 284 may be approximately centered between the first and second sides 280, 282. Other locations are possible in alternative embodiments. In an exemplary embodiment, the cover 126 includes an actuator slot 286 extending to the rear 274. The actuator slot 286 may receive a portion of the actuator 134, such as the pull tab 138. The actuator slot 286 may be aligned with the actuator slot 262 (shown in FIG. 4) of the housing 120 to cooperatively receive the pull tab 138.

The cover 126 includes locating tabs 288 extending from the inner end 278. The locating tabs 288 are used to locate the cover 126 relative to the housing 120. In an exemplary embodiment, the locating tabs 288 are oriented and shaped to be received in corresponding openings 256 (shown in FIG. 4) of the housing 120 and corresponding openings 244 (shown in FIG. 3) of the latch 130. The locating tabs 288 may be used to locate the latch 130 relative to the housing 120 and the cover 126.

In an exemplary embodiment, the cover 126 includes openings 290 extending therethrough configured to receive corresponding support posts 260 (shown in FIG. 4) of the housing 120. The openings 290 are sized and shaped to receive the corresponding support posts 260. In the illustrated embodiment, a pair of the openings 290 of provided near the center of the cover 126, such as on opposite sides of the actuator slot 286. In an exemplary embodiment, the cover 126 includes the openings 290 in mounting tabs 292 at the first and second sides 280, 282 of the cover 126. The openings 290 may be provided at other locations in alternative embodiments.

Returning to FIG. 2, the plug connector 102 is assembled by loading the latch 130 into the latch pocket 154 and the actuator 134 into the latch pocket 154 and then closing the latch pocket 154 with the cover 126. The cover 126 is secured to the housing 120 using the securing features 156. The securing features 156 are received in corresponding openings 290 to locate the cover 126 relative to the housing 120. In an exemplary embodiment, the securing features 156 are heat staked to deform the support posts 260 and secure the cover 126 to the housing 120. The actuator 134 is accessible from the exterior of the cover 126, such as through the actuator opening 284 and the actuator slots 286, 262. The cover 126 covers the main body 160 of the latch 130. The latch beams 132 extend into corresponding latch beam channels 250 and are exposed at the exterior of the plug connector 102 for latching the plug connector 102 to the receptacle connector 104 (shown in FIG. 1). When the actuator 134 is actuated, the latch beams 132 are moved to the unlatched positions causing the tip latches 200, 210 to move downward into the latch beam channels 250 to clear and unlatch from the receptacle connector 104.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A plug connector comprising:

a housing having a front and a rear, the housing having a first end and a second end opposite the first end extending between the front and the rear, the housing having a first side and a second side opposite the first side extending between the front and the rear, the housing having a mating end at the front for mating with a mating connector, the housing having a latch pocket at the first end;

plug contacts held by the housing, the plug contacts provided proximate to the mating end for mating with the mating connector; and a latch received in the latch pocket, the latch having a main body and a latch beam extending from the main body, the latch beam including a dual tip latch including a first tip latch including a first latching surface and a second tip latch including a second latching surface both configured to be received in a same latch opening of the mating connector.

2. The plug connector of claim 1, wherein the first tip latch and the second tip latch are spaced apart by a gap.

3. The plug connector of claim 1, wherein the latch beam includes a base, a first side wall extending from the base, and a second side wall extending from the base, the first tip latch extending from the first side wall opposite the base, the second tip latch extending from the second side wall opposite the base.

4. The plug connector of claim 1, wherein the latch beam is U-shaped.

5. The plug connector of claim 1, wherein the first tip latch includes a forward facing ramp and a rear facing latching surface extending from the ramp defining the first latching surface, the second tip latch including a forward facing ramp and a rear facing latching surface extending from the ramp defining the second latching surface.

6. The plug connector of claim 1, wherein the latch includes a deflecting tab associated with the main body, the plug connector further comprising an actuator operably coupled to the deflecting tab to actuate the deflecting tab, the deflecting tab causing the latch to unlatch when actuated by the actuator.

7. The plug connector of claim 1, wherein the latch beam is a first latch beam provided proximate to a first side of the main body, the latch including a second latch beam provided proximate to a second side of the mating body, the second latch beam including a dual tip latch including a first tip latch and a second tip latch both configured to be received in a same latch opening of the mating connector.

8. The plug connector of claim 1, wherein the latch includes a mounting tab associated with the main body, the mounting tab being secured to the housing.

9. The plug connector of claim 1, wherein the housing includes a latch beam channel receiving the latch beam, the latch beam being deflectable in the latch beam channel between a latched position and an unlatched position.

10. The plug connector of claim 1, further comprising a cover coupled to the first end of the housing, the cover having an end wall covering the main body of the latch, the cover having an opening, the latch extending through the opening and being accessible at the first end for latching engagement with the mating connector.

11. The plug connector of claim 1, wherein the first end includes an opening, the latch including a mounting tab having an opening aligned with the opening of the first end, the plug connector further comprising a cover coupled to the first end of the housing, the cover having a locating tab received in the opening of the latch and the opening of the first end to locate the latch relative to the housing.

12. The plug connector of claim 1, wherein the housing holds a circuit card including the plug contacts at the front.

13. The plug connector of claim 1, wherein the housing includes a card slot at the front configured to receive a circuit card of the mating connector, the plug contacts being arranged within the card slot for mating with the circuit card of the mating connector.

14. A plug connector comprising:

a housing having a front and a rear, the housing having a first end and a second end opposite the first end extending between the front and the rear, the housing having a first side and a second side opposite the first side extending between the front and the rear, the housing having a mating end at the front for mating with a mating connector, the housing having a latch pocket at the first end;

plug contacts held by the housing, the plug contacts provided proximate to the mating end for mating with the mating connector; and a latch received in the latch pocket, the latch having a main body and a latch beam extending from the main body, the latch beam including a dual tip latch, the latch beam including a base at a bottom of the latch beam, the latch beam including a first side wall extending from a first side of the base, the latch beam including a second side wall extending from a second side of the base, the second side wall being spaced apart from the first side wall by a gap, the latch beam including a first tip latch extending from a top of the first side wall including a first latching surface, the latch beam including a second tip latch extending from a top of the second side wall including a second latching surface, the first and second tip latches both configured to be received in a same latch opening of the mating connector.

15. The plug connector of claim 14, wherein the latch beam is U-shaped.

16. The plug connector of claim 14, wherein the first tip latch includes a forward facing ramp and a rear facing latching surface extending from the ramp defining the first latching surface, the second tip latch including a forward facing ramp and a rear facing latching surface extending from the ramp defining the second latching surface.

17. The plug connector of claim 14, wherein the latch beam is a first latch beam provided proximate to a first side of the main body, the latch including a second latch beam provided proximate to a second side of the mating body, the second latch beam including a dual tip latch including a first tip latch and a second tip latch both configured to be received in a same latch opening of the mating connector.

18. A plug connector comprising:

a housing having a front and a rear, the housing having a first end and a second end opposite the first end extending between the front and the rear, the housing having a first side and a second side opposite the first side extending between the front and the rear, the housing having a mating end at the front for mating with a mating connector, the housing having a latch pocket at the first end;

plug contacts held by the housing, the plug contacts provided proximate to the mating end for mating with the mating connector; and a latch received in the latch pocket, the latch having a main body extending between a first side and a second side, the latch having a first latch beam extending from the main body proximate to the first side and a second latch beam extending from the mating body proximate to the second side, the first latch beam including a dual tip latch including a first tip latch including a first latching surface and a second tip latch including a second latching surface both configured to be received in a first latch opening of the mating connector, the second latch beam including a dual tip latch including a third tip latch including a third latching surface and a fourth tip latch including a fourth latching surface both configured to be received in a second latch opening of the mating connector.

19. The plug connector of claim 18, wherein the first latch beam includes a first base, a first side wall extending from the base, and a second side wall extending from the first base, the first tip latch extending from the first side wall opposite the first base, the second tip latch extending from the second side wall opposite the first base, and wherein the second latch beam includes a second base, a third side wall extending from the second base, and a fourth side wall extending from the second base, the third tip latch extending from the third side wall opposite the second base, the fourth tip latch extending from the fourth side wall opposite the second base.

20. The plug connector of claim 18, wherein the first latch beam is U-shaped and the second latch beam is U-shaped.

* * * * *